United States Patent [19]

Kelly

[11] Patent Number: 4,561,581

[45] Date of Patent: Dec. 31, 1985

[54] WEB ACCUMULATOR WITH ARCUATE GUIDE SUPPORTS

[76] Inventor: Thomas A. Kelly, 12074 White Lake Rd., Fenton, Mich. 48430

[21] Appl. No.: 464,359

[22] Filed: Feb. 7, 1983

[51] Int. Cl.[4] ..... B65H 17/20; B65H 23/22; B65H 25/10; B65H 25/20

[52] U.S. Cl. ..... 226/113; 226/24; 226/42; 226/117; 226/118; 226/196

[58] Field of Search ..... 226/117, 118, 24, 42, 226/113, 196, 197, 198, 199, 10, 110; 242/76

[56] References Cited

U.S. PATENT DOCUMENTS

| | | | |
|---|---|---|---|
| 2,616,689 | 11/1952 | Baumgartner | 226/117 |
| 2,907,565 | 10/1959 | Sauter | 226/118 X |
| 3,107,836 | 10/1963 | Van't Veld | 226/196 |
| 3,177,749 | 4/1965 | Best et al. | 226/118 X |
| 3,240,411 | 3/1966 | Zarleng | 226/118 X |
| 3,446,409 | 5/1969 | Stearns | 226/199 X |
| 3,489,043 | 1/1970 | Dent | 226/199 X |
| 3,575,331 | 4/1971 | Middleman | 226/199 |
| 3,807,612 | 4/1974 | Eggert | 226/118 X |
| 4,194,662 | 3/1980 | Coburn | 226/110 |
| 4,365,395 | 12/1982 | Brantley | 226/118 X |

*Primary Examiner*—Harvey C. Hornsby
*Assistant Examiner*—Scott J. Haugland
*Attorney, Agent, or Firm*—Ostrolenk, Faber, Gerb & Soffen

[57] ABSTRACT

Double-faced corrugated board issuing continuously from a double backer is fed into an accumulator pit forming a downwardly extending loop therein. The web is withdrawn intermittently from the upper end of the pit and fed to a reciprocating cutting and creasing press which produces box blanks. Adjustable curved guide supports are provided for the web at the upstream and downstream ends of the accumulator. Curvatures of these supports are adjusted to permit the web, as it enters and leaves the accumulator pit, to assume curves each of a radius that approaches but is no less than a critical radius below which unwanted transverse scores will form in the web.

8 Claims, 2 Drawing Figures

WEB ACCUMULATOR WITH ARCUATE GUIDE SUPPORTS

This invention relates to an accumulator for storing part of a relatively stiff moving web.

A number of prior art processes are performed by a reciprocating press or other intermittently fed processing machine that receives a web that issues continuously from a machine which produces that web. Between the web producing and web processing machines, the web moves through an accumulator where the web forms a storage loop which can supply instantaneously the demand of at least a single feed stroke into the processing machine. Apparatus for carrying out such a process is disclosed in U.S. Pat. No. 2,616,689, issued Nov. 4, 1952, to J. R. Baumgartner for "Web Feeding Mechanism for Carton Blank Forming Machines".

Except for one exception known to the inventor hereof, prior art equipment of the type disclosed in the aforesaid U.S. Pat. No. 2,616,689 does not appear to be capable of utilizing a web of relatively stiff material, such as a double-faced corrugated board. That is, because a double-faced corrugated web is so stiff, the storage loop and any other bends in the web must be of relatively large radius to prevent formation of unwanted transverse creases or scores. In the exception known to the inventor hereof, as the web enters and leaves the storage loop, it is supported from below by the web of a U-shaped resilient member. For many web materials this type of support has proven inadequate unless false transverse scores are applied to the web prior to entry thereof into the accumulator. In addition, those resilient U-shaped members support the web over a very limited region, whereas unsupported regions of the web should be minimized, especially at the entrance and exit to the accumulator where the web path curves vertically. Support of the web at curved portions of the web path is important when the web is constructed of multilayers since the adhesive bonding the layers together is not fully cured when the web enters the accumulator and at that point in the web path moisture level in the web may be relatively high. Further, because those prior art U-shaped supports are free to flex a great deal when supporting a web, the latter is subject to fluttering which may cause layers of the web to separate or bond poorly.

In accordance with the instant invention, curved supports, adjustable in radius, are provided at each end of the accumulator to provide relatively extensive curved supports for the web as it enters and leaves the loop. There is a space between these supports, which space diminishes as the supports are adjusted for handling webs of lesser stiffness.

Accordingly, a primary object of the instant invention is to provide novel apparatus for continuously producing a relatively stiff web, and feeding the web intermittently to a processing apparatus.

Another object is to provide apparatus of this type having adjustable curved guide means for supporting a relatively stiff traveling web as it enters and leaves a storage loop.

Still another object is to provide apparatus of this type that is flexible enough to operate on a relatively wide range of web materials.

Still another object is to provide apparatus of this type having curved support members that are adjustable to positions and shapes that will substantially reduce fluttering and other agitation of the loop.

These objects, as well as other objects of this invention, shall become readily apparent after reading the following description of the accompanying drawings, in which.

Figures 1, 2:
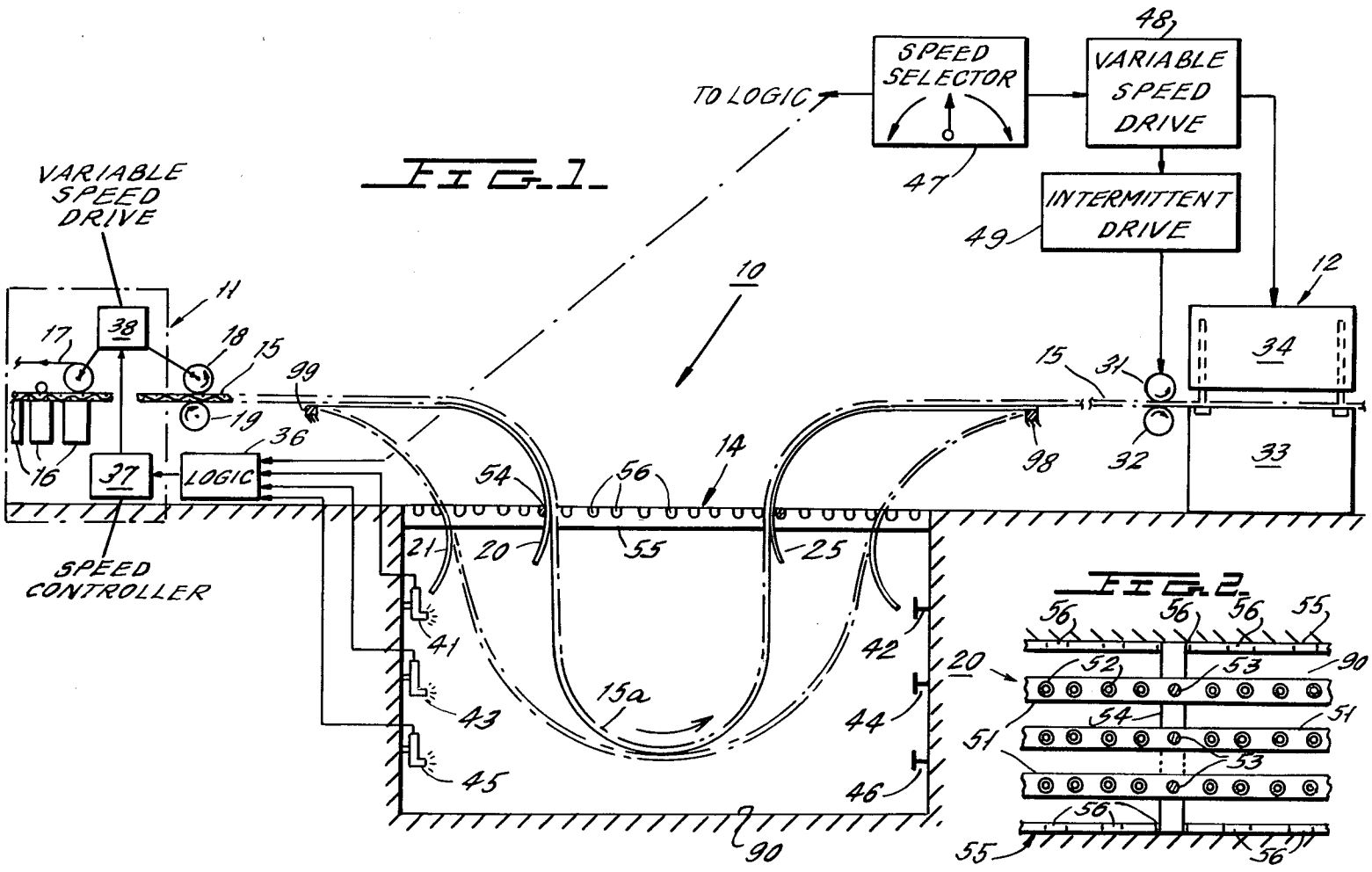
FIG. 1 is a side elevation, in schematic form, of production apparatus constructed in accordance with teachings of the instant invention.
FIG. 2 is a fragmentary plan view of one of the curved supports.

Now referring to the Figures Production apparatus 10 of FIG. 1 includes upstream production device 11, downstream processing device 12 and accumulator 14 disposed between devices 11 and 12. Production device 11 is a double-backer of a type well known to the art of producing corrugating paper board and includes a series of steam chests 16 disposed above ground level and supporting continuously moving double-faced corrugated paper web 15 formed by device 11. Continuously moving pull belt 17 of device 11 has its lower flight in pressure engagement with web 15 to move the latter from left to right with respect to FIG. 1.

After issuing from device 11, web 15 passes between continuously rotating feed roll 18, 19, then moves over a portion of curved support 20, across the space between guide 20 and curved guide 25 (moving in an upwardly curving path supported by guide 25) and then between intermittently rotated feed roll 31, 32 which deliver web 15 to processing device 12. The latter is a conventional cutting and creasing press having fixed lower platen 33 and reciprocating upper platen 34 between which web 15 is fed. Accumulator 14 includes pit 90 which receives the unsupported single downward loop section 15*a* of web 15 which spans the space between curved supports 20 and 25.

At the upstream end of pit 90 are upper, middle and lower vertically adjustable light transmitter/receiver units 41, 43, 45, respectively, and at the downstream end of accumulator 14 are upper, middle and lower light reflectors 42, 44, 46, respectively, positioned to receive light originating from the respective units 41, 43, 45 in a manner well known to the art. Transmitter/receivers 41, 43, 45 will produce outputs indicating whether or not they are receiving light reflected by their associated reflectors 42, 44, 46. The outputs of units 41, 43, 45 are fed to logic unit 36 whose output varies speed controller 37 for controlling operation of variable speed drive 38. Preferably, controller 37 will operate to gradually change the speed of drive 38. Outputs of the latter operate pull belts 17 and pull rolls 18, 19. The frequency of operation for processing device 12 is controlled by speed selector 47 that controls the operation of variable speed drive 48. The latter produces two outputs, one going directly to processing device 12 and the other acting through intermittent drive 49 to operate pull rolls 31, 32. An output from speed selector 47 is also fed to logic 36.

As is well known to the art, the position of loop 15*a* in pit 90 determines whether or not light reaches reflectors 42, 44, 46. That is, when loop 15*a* sags below unit 45, light will not impinge upon any of the reflectors 42, 44, 46. When this condition is detected at logic 36, drive 38 will be shut down to prevent loop 15*a* from expanding to the bottom of accumulator pit 14. Abrupt contact between loop 15*a* and the bottom of accumulator pit 14 could damage web 15 and the latter could also be damaged by being forced to rub against the bottom of accumulator pit 14.

When drive 38 is shut down, web 15 no longer feeds into accumulator 14 so that loop 15*a* rises as material is drawn out of accumulator 14 through the operation of pull rolls 31, 32. Once loop 15*a* rises above device 45, logic 36 directs drive 38 to operate at a speed that will feed web 15 slowly into accumulator 14. When reflected light is received by device 43, logic 36 will act to increase the speed of drive 38, which speed will increase markedly in the event loop 15*a* rises above device 41.

Curved support guide 20 is secured at its upstream end to fixed transverse member 99 and the downstream end of curved guide support 25 is secured to fixed transverse member 98. Supports 20, 25 are often adjusted to be mirror images of one another. Their constructions are essentially the same so that only the construction and mounting of one of them will be described.

Support 20 includes a plurality of slats 51 constructed of resiliently deformable material, preferably steel, and shaped so that it is normally retained in a curve. Disposed along the length of each of the slats 51 are spaced countersunk apertures 52 for receiving screws 53 that extend into transverse wooden slat 54. The ends of slat 54 are inserted into selected upwardly open notches 56 in rails 55 disposed along opposite sides of accumulator pit 90 at the top thereof. The curvature of support 20 is adjusted by repositioning transverse slat 54 along the length of curved slats 51 and selecting appropriately located recesses 56 to receive the ends of transverse slat 54. In FIG. 1 the solid line position of support 20 provides a support curve of relatively small radius, say for supporting E-flute double-face corrugated board, while the phantom position for support 20 provides a support curve of much greater radius, say for supporting B-flute board which is twice as thick as and usually much stiffer than E-flute board. The natural curve of each slat 54 is expanded when support 20 is adjusted to its operative web supporting positions, two of which are shown in FIG. 1.

The radius of the support curve provided by guides 20, 25 is determined by the critical radius for the particular web 15 being handled. That is, the critical radius is the smallest radius which web 15 can be curved to without false scores or creases being formed therein. Critical radius increases as the stiffness of web 15 increases. As the critical radius decreases, it is beneficial to decrease the spacing between curved guide supports 20, 25, thereby decreasing the length of unsupported web material within accumulator pit 90. Preferably, the support arc provided by each support 20, 25 for web 15 will be approximately 90°.

Typically, accumulator pit 90 is 22 feet long (direction of web travel) by 8 feet wide by 8 feed deep. Rollers, 18, 19 may deliver web 15 at 560 feet/minute, and press 12 will form 160 sheets/minute with web 15 advancing 42 inches for each operation of rollers 31, 32.

It should be understood by those skilled in the art that a so-called preprinted liner may be used to form double-faced corrugated web 15 or the web 15 issuing from double backer 11 may pass through a printer before entering accumulator 14.

Although the present invention has been described in connection with a preferred embodiment thereof, many variations and modifications will now become apparent to those skilled in the art. It is preferred, thereofre, that the present invention be limited not by the specific disclosure herein, but only by the appended claims.

What is claimed is:

1. Production apparatus including:

a production device for manufacturing a traveling web of material having stiffness properties similar to those of double-faced corrugated paper board;

a web processing device downstream of said production device;

an accumulator disposed between said production device and said web processing device and through which said web, while void of tranverse score lines, travels in a path comprising a partial downwardly extending loop;

first drive means for delivering the web continuously from said production device to the upstream end of said accumulator;

second drive means for withdrawing the web intermittently from the downstream end of said accumulator and delivering the web to said web processing device;

a convex first means curved downwardly in a downstream direction for supporting said web from below as it enters said accumulator, a convex second means curved downwardly in an upstream direction supporting said web from below as it leaves said accumulator, said first and second means being operatively shaped to permit said web, as it enters and leaves said loop, to be supported along curves each having a radius approaching but no less than a critical radius below which unwanted transverse scores will form in the web;

said first means extending downward and downstream from a first fixed support and said second means extending downward and upstream of a second fixed support with there being a substantial space between said first and second means, said first means being free at its downstream end and said second means being free at its upstream end;

adjusting means operable to selectively adjust curvature of said first and second means, said adjusting means including first and second members extending transverse to direction of web travel;

each of the first and second means including a plurality of parallel slats spaced transverse to direction of travel of the web, said slats of said first means being connected to said first member downstream of said first fixed support and said slats of said second means being connected to said second member upstream of said second fixed support;

said first and second members being adjustably positionable upstream and downstream with respect to said fixed supports;

said first member being adjustably positionable lengthwise of said slats of said first means, and said second member being adjustably positionable lengthwise of said slats of said second means.

2. Production apparatus as set forth in claim 1 in which each of said first and second means supports said web along a curve extending for approximately 90°.

3. Production apparatus as set forth in claim 1 in which the space between the first and second means changes as said first and second means have their curvatures adjusted by operation of said adjusting means.

4. Production apparatus as set forth in claim 3 in which each of said first and second means supports said web along a curve extending for approximately 90°.

5. Production apparatus as set forth in claim 4 in which the first means at its free end is upstream of a section of said first means disposed intermediate the ends thereof; and the second means at its free end is downstream of a section of said second means disposed intermediate the ends thereof.

6. Production apparatus as set forth in claim 1 in which the first means at its free end is upstream of a section of said first means disposed intermediate the ends thereof; and the second means at its free end is downstream of a section of said second means disposed intermediate the ends thereof.

7. Production apparatus as set forth in claim 6 in which the space between the first and second means changes as said first and second means have their curvatures adjusted by operation of said adjusting means.

8. Production apparatus as set forth in claim 6 in which each of said first and second means supports said web along a curve extending for approximately 90°.

* * * * *